US005878882A

United States Patent [19]

Kohagura

[11] Patent Number: 5,878,882

[45] Date of Patent: Mar. 9, 1999

[54] TOOLBOX ASSEMBLY

[76] Inventor: Ronald S. Kohagura, 7749 Toland Ave., Los Angeles, Calif. 90045

[21] Appl. No.: 926,988

[22] Filed: Sep. 10, 1997

[51] Int. Cl.[6] ..... B65D 85/28

[52] U.S. Cl. ..... 206/379; 211/69; 206/560; 206/758

[58] Field of Search ..... 206/372, 373, 206/379, 443, 758, 756, 764, 765, 488, 560, 565; 211/69; 408/241 R; 269/43, 287; 451/375, 365

[56] References Cited

U.S. PATENT DOCUMENTS

| | | | |
|---|---|---|---|
| 3,942,780 | 3/1976 | Clement | 269/47 |
| 4,030,599 | 6/1977 | Bruni | 206/379 |
| 4,184,592 | 1/1980 | Howard, Jr. | 206/327 |
| 4,880,122 | 11/1989 | Martindell | 206/560 |
| 5,337,894 | 8/1994 | Ivey | 206/370 |
| 5,344,012 | 9/1994 | Matthews | 206/372 |

*Primary Examiner*—Paul T. Sewell
*Assistant Examiner*—Nhan T. Lam
*Attorney, Agent, or Firm*—Benman & Collins

[57] ABSTRACT

A tool box assembly having a first surface with a first aperture therethrough for retaining a tool (such as a drill bit) having a longitudinal axis. A second surface is provided having a second aperture therethrough for retaining the tool. The first surface is retained relative to the second surface whereby the tool may translate along the longitudinal axis thereof through the first aperture in the first surface and the second aperture in the second surface when the first surface is in a first position relative to the second surface land be restrained against translation along the longitudinal axis thereof when the first surface is in a second position relative to the second surface.

19 Claims, 5 Drawing Sheets

TOOLBOX ASSEMBLY

BACKGROUND OF THE INVENTION

1. Field of the Invention

The present invention relates to tools. More specifically, the present invention relates to containers for holding drill bits and the like.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Certain applications require a large number of tools that are difficult to maintain in a secure yet orderly arrangement due to the small size thereof. Dentistry is one example, circuit board manufacture is another. In the manufacture of circuit boards, a number of holes are drilled in each board to facilitate the alignment and mounting thereof on a chassis or frame. The number of holes may vary from 10 to several hundred. Generally, these bits are very expensive, small (on the order of ⅛th of an inch in diameter) and made of a high strength material (e.g., carbide).

As the bits generally wear or break after a number of holes have been drilled, it is important to keep an adequate supply of bits on hand. Several tool boxes have been developed over the years to retain such drill bits when the bits are not being used. One such box includes an array of apertures sized to retain the bits in an upright position. A layer of foam was placed over the bits to hold them in place. Unfortunately, the bits often became stuck in the foam and were inadvertently extracted whenever the foam was lifted to remove a single bit. This caused a number of bits to become displaced and, in some cases, led to bits being dropped, broken and/or lost.

A second approach replaced the foam with a plastic retainer having a matching array of apertures for holding the bits in place. However, this design was found to be bulky and awkward to reassemble.

A third approach involved the use of an array of apertures which held the bits by supporting an identifying ring disposed on the bit. Ribs under the cover of the container pressed on the rings or the taper of the bits and thereby held the bits in place. Unfortunately, since this approach required a 'top hold-down', it required a number of parts and was therefore expensive and bulky.

The top hold-down approach was used in various configurations all of which suffered from the cost, complexity and bulkiness associated with a top hold-down structure.

Thus, a need remains in the art for a simple, inexpensive yet effective receptacle for drill bits and other tools that retains the tools in a secure and orderly fashion.

SUMMARY OF THE INVENTION

The need in the art is addressed by the container of the present invention. In a most general sense, the invention includes a first surface having a first aperture therethrough for retaining a tool (such as a drill bit) having a longitudinal axis. A second surface is provided having a second aperture therethrough for retaining the tool. Finally, a mechanism is included for retaining the first surface relative to the second surface whereby the tool may translate along the longitudinal axis thereof through the first aperture in the first surface and the second aperture in the second surface when the first surface is in a first position relative to the second surface and be restrained against translation along the longitudinal axis thereof when the first surface is in a second position relative to the second surface.

In the illustrative embodiment, the first and second surfaces each include a matching array of apertures. The first surface is generally planar and rigid and translates relative to the second surface from the first position to the second position along an axis which is transverse to the longitudinal axis of the tool. Although the second surface is also generally planar, the apertures in the second surface are pear-shaped and have a first radius at a distal end and a second radius at proximal end thereof, the first radius being greater than the second radius. The periphery of the apertures in the second surface at the proximal end thereof are pliant.

The first surface is part of a shell into which the second surface slides as an insert. The shell retains each of the apertures in the first surface in alignment with the distal end of a corresponding one of the apertures in the second surface when the first surface is in the first position relative thereto. The shell retains each of the apertures in the first surface in alignment with the proximal end of the corresponding one of the apertures in the second surface when the first surface is in the second position relative to the second surface. The tool or bit is restrained against longitudinal translation by a pliant peripheral edge of an aperture in the second surface when the first surface is in the second position relative to the second surface. A cam lever is provided for reciprocating the second surface from the first position to the second position relative to the first surface.

BRIEF DESCRIPTION OF THE DRAWINGS

FIG. 3(*b*) shows an insert which slides into the shell of the tool box assembly of FIG. 3(*a*) in accordance with the teachings of the present invention.

FIG. 3(*c*) depicts a one-quarter perspective view of the cam lever relative to the insert used in the tool box assembly of the present invention.

DESCRIPTION OF THE INVENTION

Illustrative embodiments and exemplary applications will now be described with reference to the accompanying drawings to disclose the advantageous teachings of the present invention.

Figure 1:
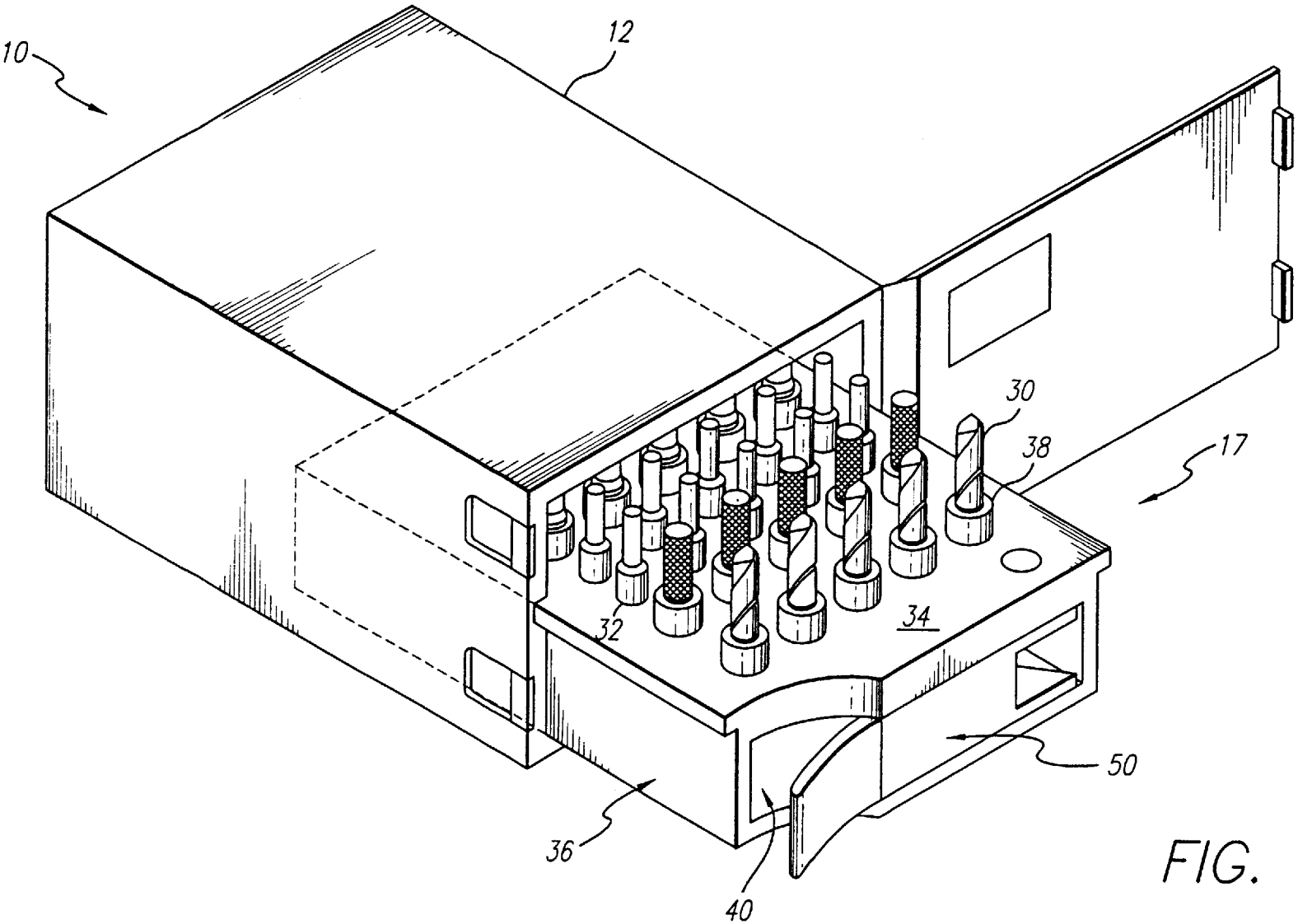
FIG. 1 is a perspective view of an illustrative embodiment of the tool box assembly of the present invention.

FIG. 1 is a perspective view of an illustrative embodiment of the tool box assembly of the present invention. In FIG. 1, assembly 10 has a housing 12 adapted to retain two magazines 14 and 16.

Figure 2:
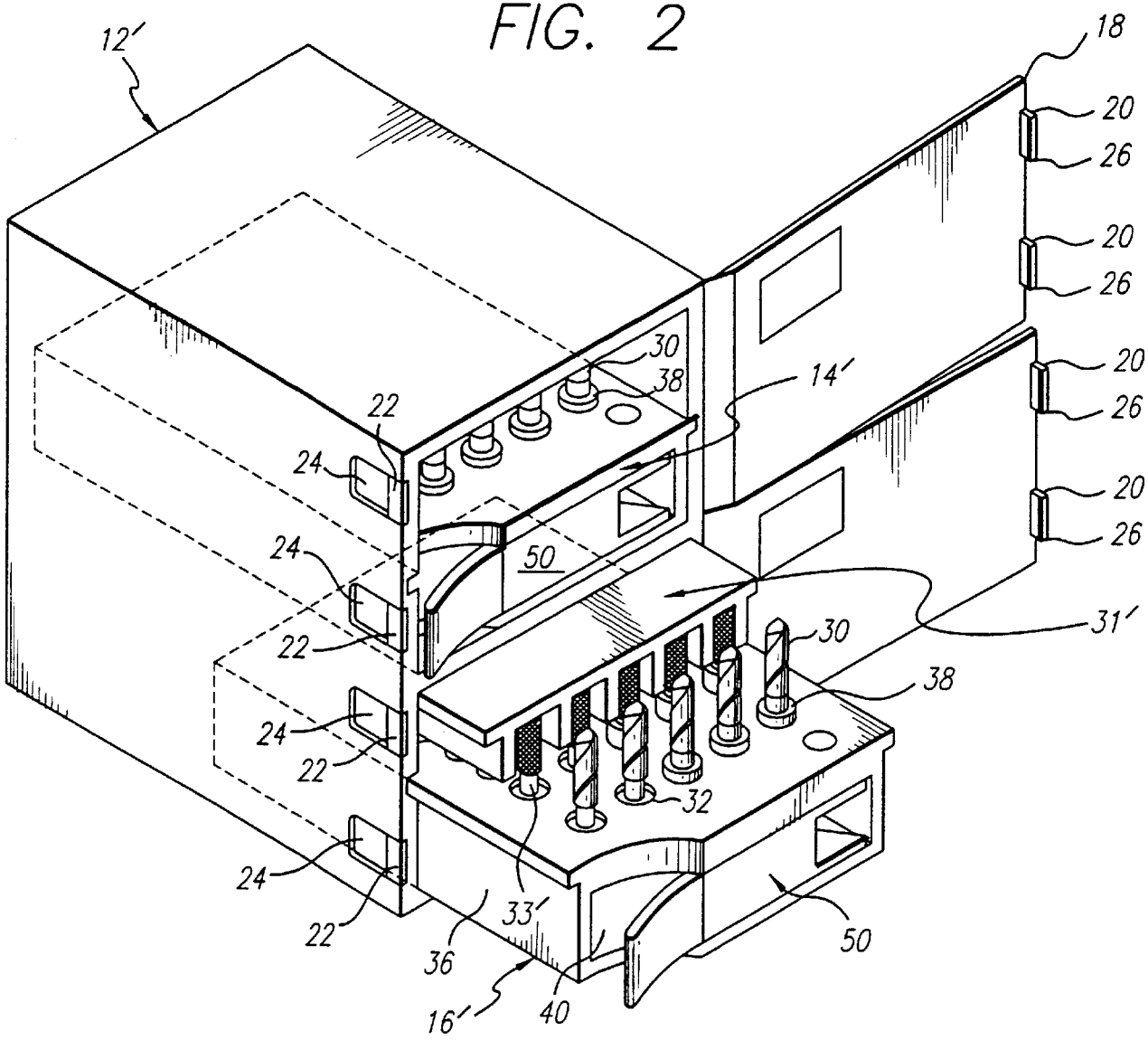
FIG. 2 is a perspective view of an alternative embodiment of the tool box assembly of the present invention adapted to retain multiple magazines.

FIG. 2 is a perspective view of an alternative embodiment of the tool box assembly of the present invention adapted to retain multiple magazines. The alternative embodiment 10' of FIG. 2 illustrates that the invention is not limited to the number of magazines that may be retained within a single integrated housing 12'.

Returning to the illustrative embodiment of FIG. 1, the enclosure 12 is made of plastic or other suitable material which may be clear or colored as desired. The enclosure 12 is rectangular and has an open end secured by a cover 18. The cover 18 has plural tabs 20 which flex over the edge of the enclosure and engage lips 22 in recesses 24. Each tab 20 has a protrusion 26 which snaps in place in a recess 24 against a lip 22 and secures the cover 18 in a closed position. An elongate opening 28 (not shown) is disposed at a second end of the enclosure 12 opposite the open end which allows for the insertion of a finger to facilitate the removal of a magazine.

In FIG. 1, the magazine 14 is shown partially removed whereas in FIG. 2, the first magazine 14' is shown fully inserted in the enclosure 12' and the second magazine 16' is shown partially removed. Clearly, the enclosure 12 or 12' may be designed to allow for a complete or partial removal of a magazine without departing from the scope of the present invention.

As shown in FIGS. 1 and 2, each magazine is designed to retain a plurality of elongate tools or drill bits 30. Each bit 30 is adapted to translate along the longitudinal axis thereof into and out of an aperture 32 in a first surface 34 of a shell 36. The bits 30 may rest on an identifying ring 38 which sits on the first surface 34.

Figure 3C:
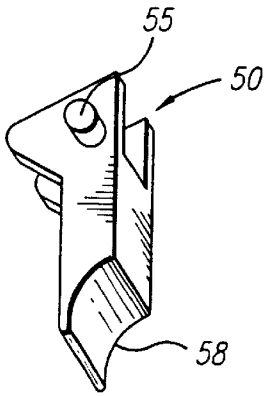
FIG. 3(*a*) is a top view of the shell of the tool box assembly of the present invention.
Figure 3B:
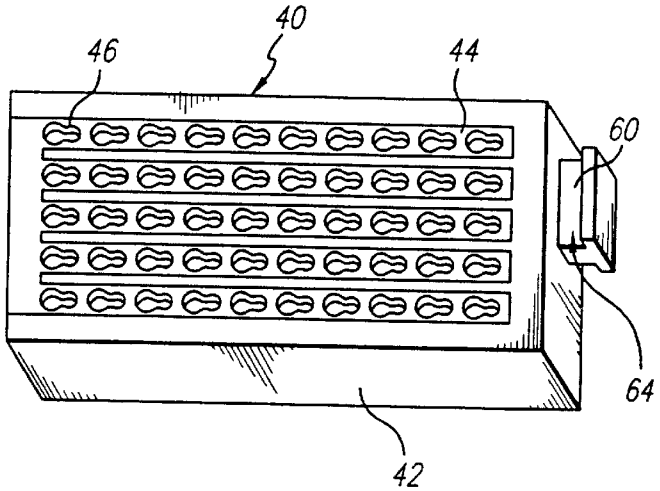
Figure 3A:
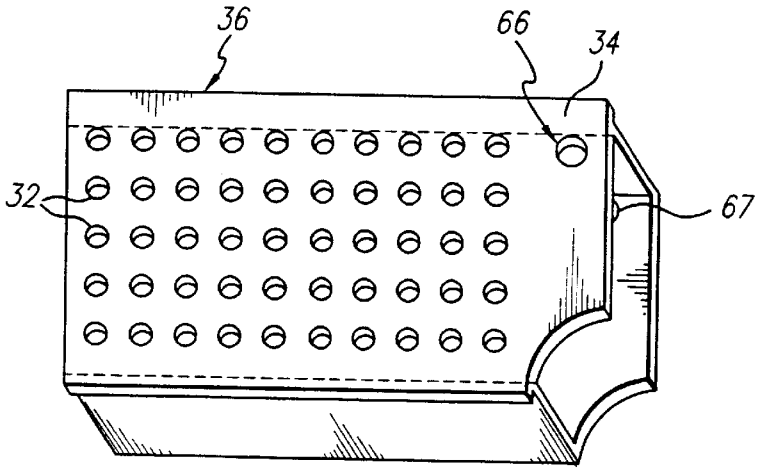

FIG. 3(*a*) is a top view of the shell 36 of the tool box assembly of the present invention. FIG. 3(*a*) shows an array of 50 apertures 32 in the first (upper) surface 34 of the shell 36.

FIG. 3(*b*) shows an insert 40 which slides into the shell 36 of FIG. 3(*a*). The insert 40 includes a frame 42 constructed of rigid plastic or other suitable material. Disposed within the rigid frame 42 is a layer 44 of pliant material. A second array of apertures 46 is provided within the layer 44. Each of the apertures 46 is pear-shaped having a first radius at a distal end and a second radius at a proximal end, the first radius being greater than the second radius. The first radius is chosen to allow for ease of translation of a bit 30 into the aperture 46. The second radius is chosen to hold a bit 30 against translation along the longitudinal axis thereof Hence, when the insert 40 is in a first position, the distal ends of the apertures 44 thereof are in alignment with the apertures 32 of the shell 36 and bits 30 are easily inserted therethrough.

Figure 4A:
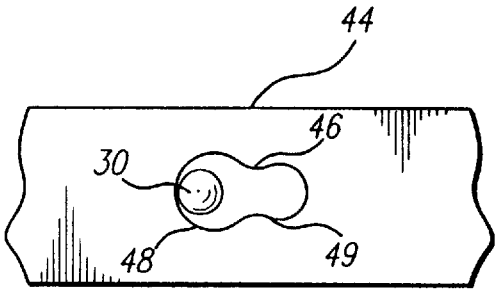
FIG. 4*a* depicts the shell and insert of the tool box assembly of the present invention in a first relative position at which a bit extends through an aperture in the shell into the distal end of an aperture in the insert.
Figure 4B:
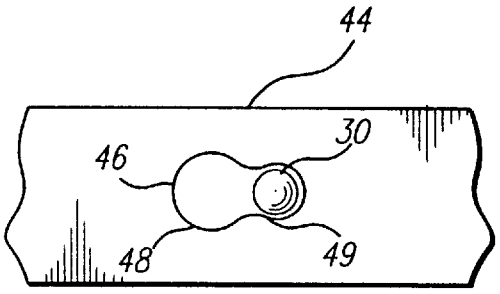
FIG. 4*b* depicts the shell and insert of the tool box assembly of the present invention in a second relative position at which the bit is translated along an axis transverse to the longitudinal axis thereof into the proximal end of the aperture in the insert as shown.

This is illustrated in FIGS. 4*a* and 4*b* which depict the mechanism of the present invention by which tools are held secure against translational motion. In FIG. 4*a*, the shell 36 and insert 40 are depicted in the first relative position at which the bit 30 extends through an aperture 32 in the shell 36 and into the distal end 48 of an aperture 46 in the insert 40. In FIG. 4*b*, the shell 36 and insert 40 are depicted in a second relative position at which the bit 30 is translated along an axis transverse to the longitudinal axis thereof into the position shown. In the second position, the bit 30 is secured against motion along the longitudinal axis thereof by the inner walls of the proximal end 49 of the aperture 46.

Figure 5:
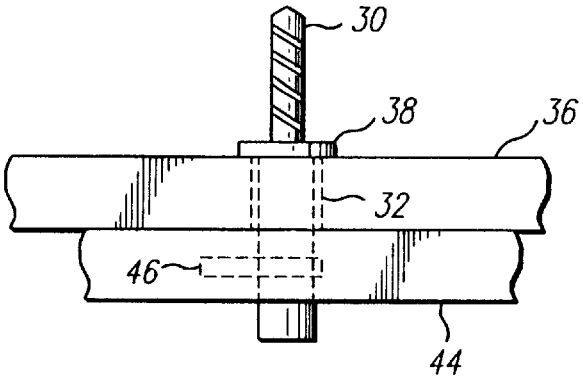
FIG. 5 is a partial side view showing a bit extending through the aperture in the shell and the aperture in the layer in the second position in accordance with the teachings of the present invention.

FIG. 5 is a partial side view showing a bit 30 extending through the aperture 32 in the shell 36 and the aperture 46 in the layer 44 in the second position in accordance with the teachings of the present invention.

Figure 6:
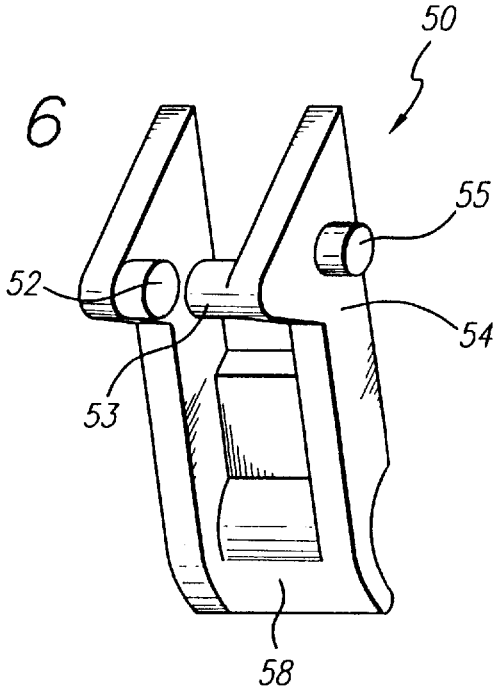
FIG. 6 is a three-quarter perspective view of the cam lever used in the tool box assembly of the present invention.

The insert 40 is moved from the first position to the second position relative to the shell 36 by a cam lever arrangement. The cam lever is depicted in FIG. 6. The cam lever 50 includes a first set of pins 52, 53 mounted inside a cam 54 at a first end of the lever 50. A second set of pins 55, 56 are disposed on the outside of the first end of the cam lever 50. The second end of the cam 50 provides a handle 58 for lifting the lever 50. The first set of pins 52, 53 engage slots 60, 62 in a cam slot 64 to the frame 42 of the insert 40 as depicted in FIGS. 3(*b*) and (*c*). The second set of pins 55, 56 on the cam lever 50 engage pivot holes 66, 67 in the shell 36 depicted in FIG. 3(*a*). The cam lever 50 and cam slot 64 made by made of rigid plastic or other suitable material.

Figure 7:
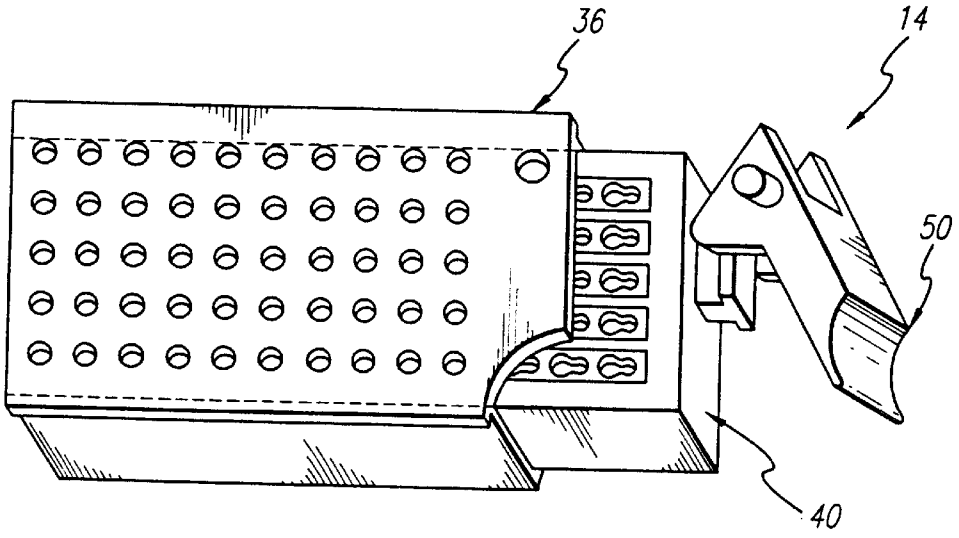
FIG. 7 shows the magazine of the tool box of the present invention with the insert partially removed from the shell.

In operation, the insert 40 is slid into the shell 36 as depicted in FIG. 7 until the apertures 32 in the shell 36 are in alignment with the large distal end of the apertures 46 in the insert 40 (the first relative position described above). At this time, the drill bits 30 are inserted through the apertures 32 into the distal ends 48 of the apertures 46. Thereafter, the lever 50 and the insert 40 are pushed further into the shell 36 whereby the drill bits 30 are forced by the first surface 34 from the distal ends 48 of the apertures 46 into the proximal ends 49 thereof and thereby secured by the layer 44. The magazine 14 may then be stored in the enclosure 12.

Figure 8:
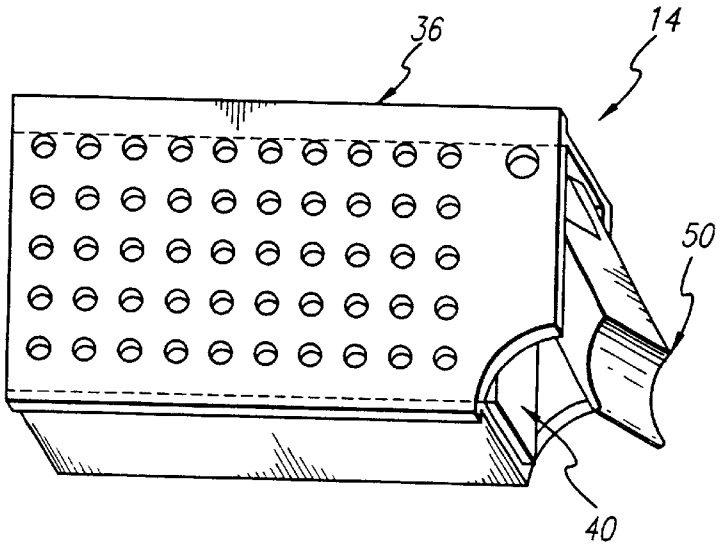
FIG. 8 shows the magazine of the tool box of the present invention with the insert installed in the shell.

Release of the bits 30 is effected by lifting cam lever 50 as depicted in FIG. 8. The cam presses against the shell 36 and the frame 40 and moves the bits 30 from the proximal ends 49 of the apertures 46 into the larger distal ends permitting translation of the bits along the longitudinal axes thereof Note that a safety feature of the invention is due to the fact that the cover 18 will not close if the lever 50 is not depressed.

Returning to the embodiment of FIG. 2, note that a hold down 31' is provided as an option. The optional hold down 31' may be used to restrain bits 33' which are inserted into the apertures 32 upside down. Bits that are due to be reground, sharpen, replaced or otherwise set aside, may be inverted for ease of identification. The optional hold down unit 31', being of conventional design, construction, and operation, serves to restrain the inverted bits and prevent the dislodging of same from the apertures 32.

Thus, the present invention has been described herein with reference to a particular embodiment for a particular application. Those having ordinary skill in the art and access to the present teachings will recognize additional modifications applications and embodiments within the scope thereof. For example, smaller tool holders (e.g., 10 and 20 count) may use pliant surfaces for interference restraint in lieu of lever action.

It is therefore intended by the appended claims to cover any and all such applications, modifications and embodiments within the scope of the present invention.

Accordingly,

What is claimed is:

1. A container for holding a plurality of elongate tools comprising:

first means having a first aperture therethrough for retaining a tool having a longitudinal axis;

second means having a second aperture therethrough for retaining the tool;

third means for retaining the first means relative to the second means whereby the tool may translate along the longitudinal axis thereof through the aperture in the first means and the aperture in the second means when the first means is in a first position relative to the second means and whereby the tool is restrained against translation along the longitudinal axis thereof when the first means is in a second position relative to the second means and fourth means for reciprocating the second means from the first position to the second position relative to the first means, said fourth means including a cam and a lever for actuating the cam from a first cam position to a second cam position.

2. The invention of claim 1 wherein the first means translates relative to the second means from the first position to the second position along an axis which is transverse to the longitudinal axis of the tool.

3. The invention of claim 1 wherein the first means has a first planar surface.

4. The invention of claim 3 wherein the first surface is constructed of uniformly rigid material.

5. The invention of claim 3 wherein the second means has a second planar surface.

6. The invention of claim 5 wherein the second aperture in the second means is pear-shaped having a first radius at a distal end and a second radius at proximal end thereof, the first radius being greater than the second radius.

7. The invention of claim 6 wherein the periphery of the second aperture in the second means at the proximal end thereof is pliant.

8. The invention of claim 7 wherein the first means includes a first array of first apertures.

9. The invention of claim 8 wherein the second means includes a second array of second apertures, each having a distal end and a proximal end.

10. The invention of claim 9 wherein the third means retains each of first apertures in the first array in alignment with the distal end of a corresponding one of the second apertures in the second array when the first means is in the first position relative to the second means and the third means retains each of the first apertures in the first array in alignment with the proximal end of the corresponding one of the second apertures in the second array when the first means is in the second position relative to the second means.

11. The invention of claim 10 wherein the second aperture includes a pliant peripheral edge which restrains the tool against longitudinal translation when the first means is in the second position relative to the second means.

12. The invention of claim 1 wherein the cam lever includes a cam mounted on the first means and adapted to engage the second means when actuated from the first cam position to the second cam position whereby the second means is moved from the first position to the second position relative to the first means.

13. The invention of claim 12 wherein the cam lever includes means for moving the second means relative to the first means from the second position to the first position when the cam is moved from the second position to the first position.

14. The invention of claim 1 wherein the third means is an open-ended rectangular shell.

15. The invention of claim 14 wherein the first means is a surface of the shell.

16. The invention of claim 15 wherein the second means is adapted to translate from the first position to the second position within the shell.

17. The invention of claim 16 further including an enclosure adapted to receive the shell.

18. The invention of claim 17 wherein the enclosure includes means for receiving plural shells.

19. The invention of claim 17 wherein the enclosure is open at one end to receive the shell and has an aperture at the opposite end to facilitate the removal of the shell therefrom.

* * * * *

UNITED STATES PATENT AND TRADEMARK OFFICE

CERTIFICATE OF CORRECTION

PATENT NO : 5,878,882

DATED : March 9, 1999

INVENTOR(S) : Ronald S. Kohagura

It is certified that error appears in the above-identified patent and that said Letters Patent is hereby corrected as shown below:

On title page, in the Abstract, line 9, change "land" to --and--

Description of the Invention, column 4, line 22, delete "made by"

Description of the Invention, column 4, line 46, change "sharpen" to --sharpened--

Signed and Sealed this

Tenth Day of October, 2000

*Attest:*

Q. TODD DICKINSON

*Attesting Officer*

*Director of Patents and Trademarks*